US006024682A

United States Patent [19]

Mandel et al.

[11] Patent Number: 6,024,682

[45] Date of Patent: Feb. 15, 2000

[54] AUTOMATICALLY CONTINUOUSLY VARIABLE FOLD POSITION SHEET FOLDING SYSTEM WITH AUTOMATIC LENGTH AND SKEW CORRECTION

[75] Inventors: Barry P. Mandel, Fairport; Joseph J. Ferrara, Webster, both of N.Y.

[73] Assignee: Xerox Corporation, Stamford, Conn.

[21] Appl. No.: 09/197,976

[22] Filed: Nov. 23, 1998

[51] Int. Cl.[7] ..... B31B 1/00

[52] U.S. Cl. ..... 493/23; 493/25; 493/419; 493/420; 270/32; 270/45

[58] Field of Search ..... 493/23, 25, 419, 493/420, 437, 444, 34, 37; 270/32, 45; 271/288, 303, 301, 902

[56] References Cited

U.S. PATENT DOCUMENTS

| | | | |
|---|---|---|---|
| 4,900,391 | 2/1990 | Mandel et al. | 156/364 |
| 5,076,556 | 12/1991 | Mandel | 270/45 |
| 5,131,649 | 7/1992 | Martin et al. | 271/302 |
| 5,242,364 | 9/1993 | Lehmann | 493/34 |
| 5,267,933 | 12/1993 | Precoma | 493/23 |
| 5,364,332 | 11/1994 | Gray, Jr. | 493/23 |
| 5,377,965 | 1/1995 | Mandel et al. | 270/37 |
| 5,683,338 | 11/1997 | Krasuski et al. | 493/37 |

OTHER PUBLICATIONS

"Jun. 1984" dated Xerox Corp. "1055" product "Technical Overview", description of a sheet "Folder/Inverter" on p. 12–10, 12–6, 12–7 and 12–9.

*Primary Examiner*—Eugene L. Kim

[57] ABSTRACT

An improved sheet folder for flimsy printed sheets with an automatic fold position correction system. The folder may have an input sheet feeder, a fold chute with a chute entrance, reversible sheet feeding rollers in the fold chute adjacent to the chute entrance, fold rollers, a folded sheets output path, and a sensor system for sensing the length of folded sheets in the folded sheets output path. A sheet to be folded is may be partially fed into the fold chute, engaged by the reversible rollers, and fed thereby further into the chute by a selected distance corresponding to a desired folding position along the sheet. Then, the reversible rollers are stopped at a selected sheet stopping position and reversed to feed the sheet into the fold rollers, cooperatively with the input sheet feeder. The fold rollers feed the folded sheet into the folded sheets output path. The sensor system there provides a control signal modifying the selected stopping position of the reversible rollers, to provide a fold position correction system. For integral or separate fold skew correction, the reversible rollers are transversely spaced and separately servo driven, and the sensor system is a plural sensor array extending transversely across the folded sheets path to provide skew correction signals differently controlling the selected stopping positions of the separately driven reversible rollers. Additionally disclosed is a special fold position correction system for ½ or even-folded sheets.

8 Claims, 7 Drawing Sheets

AUTOMATICALLY CONTINUOUSLY VARIABLE FOLD POSITION SHEET FOLDING SYSTEM WITH AUTOMATIC LENGTH AND SKEW CORRECTION

Cross-reference and incorporation by reference is made to a contemporaneously filed application of the same assignee, Docket No. D/98702, entitled "DUAL MODE INVERTER AND AUTOMATIC VARIABLE FOLD POSITION SHEET FOLDING SYSTEM" by Jason P. Rider, app. Ser. No. 09/197,850.

Disclosed in the embodiments herein is an improved, more automatic, system for folding printed sheets, especially printed sheets outputted from a reproduction system, with a feedback control system for automatically correcting for folding position errors and/or folding skew errors, which control system can automatically provide correct variable folding of sheets at almost any desired fold position along the sheet without requiring resetting of mechanical sheet stop or registration members.

Numerous types of sheet folding systems, including buckle-type sheet folding systems with folding rollers, with or without reciprocating blade or knife-edge folding assistance devices, are well known in the art. The following patent disclosures are noted merely as examples: Xerox Corp. U.S. Pat. No. 5,377,965 issued Jan. 3, 1995, Xerox Corp. U.S. Pat. No. 4,900,391 issued Feb. 3, 1990, and U.S. Pat. No. 5,076,556 issued Dec. 31, 1991, to the same Barry P. Mandel, et al, and other references cited therein. Also noted is FIG. 1 herein, labeled "Prior Art", showing a folding system with a selectable limited plural choice of plural solenoid actuated mechanical fixed position fold stops. It is also well know to provide a sheet folding system with a manually slideable or otherwise repositionable mechanical fold stop, for changing the desired fold position on the sheet, or for accommodating different sheet sizes, which requires an operator to mechanically unbolt, move, and re-bolt the fold stop in its new position.

Of particular interest is Xerox Corp. U.S. Pat. No. 5,364,332 issued Nov. 15, 1994 to Gary A. Grey, Jr. (D/90012) on a sheet folder, disclosing for example in its "Abstract" that:

"Folding is accomplished by feeding a copy sheet into a stepper/servo controlled pinch roll that is under software control. The copy sheet is measured and the reversible roll nip is cycled from full forward to full reverse velocity with controlled acceleration. The reversing of the sheet causes a buckle to be created and the sheet creased by a secondary set of rolls."

Of background interest is a "6/84" dated Xerox Corp. "1055" product "Technical Overview", description of a sheet "Folder/inverter" on p. 12-10, 12-6, 12-7 and 12-9. However, it is specifically stated in this description that only 11×17 inch (A3 size) paper can be folded with this system. The folder and inverter are in the same modular pullout unit in this "1055" copier, and share some components and paper paths. However, as understood from this "1055" descriptive material, a solenoid actuated folder stop finger inserted at or past the downstream end of the inverter or sheet reversing chute stops the lead edge of a large size 11×17 sheet fed therein before the trail end of that same large sheet clears the entrance rollers. This causes the sheet to buckle in the center of the sheet, and that buckled paper is forced between the lower entrance roll and an inverter roll, at the upstream, entrance, end of the inverter chute. The pressure between those two rollers causes the fold in the paper. The folded paper then feeds around the inverter roll and on to the exit area.

In another type of sheet handling system, sheet inverters, it is known to provide sheet inverters with reversible rolls in the inverter chute, and to do so as part of an overall sheet output system with multiple sheet output paths, in which the inverter provides a path gating station, as shown for example in Xerox Corp. U.S. Pat. No. 5,131,649 issued Jul. 21, 1992 to M. J. Martin, et al.

The subject sheet folding system can enhance the capabilities of the above-described and other traditional sheet buckle folders by automatically providing for an adjustable fold position almost anywhere along a sheet, for various sizes of sheets, with a feedback system to correct fold position and/or fold skew.

A specific feature of the specific embodiments disclosed herein is to provide an improved sheet folder for folding flimsy printed sheets, with an automatic feedback controlled fold position correction system, comprising input sheet feed rollers, a fold chute with a chute entrance, reversible sheet feeding rollers in said fold chute, fold rollers, a folded sheets output path, and a sensor system for the folded sheets in said folded sheets output path, wherein a sheet to be folded is partially fed into said fold chute by said input sheet feed rollers and a downstream portion of said sheet is engaged in said chute by said reversible sheet feeding rollers and fed further into said chute by said reversible sheet feeding rollers by a selected distance corresponding to a desired fold position for said sheet, and then said reversible sheet feeding rollers are stopped at a selected stopping position relative to said sheet and reversed to feed said desired fold position of said sheet into said fold rollers for folding said sheet with both said reversible sheet feeding rollers and said input sheet feed rollers, and wherein said fold rollers then feeds said folded sheet into said folded sheets output path, wherein said sensor in said folded sheets output path senses the length of folded sheets in said folded sheets output path to provide a control signal for controlling said selected stopping position of said reversible sheet feeding rollers to provide said fold position correction system.

Further specific features disclosed herein, individually or in combination, include those wherein said reversible sheet feeding rollers are mounted adjacent to said chute entrance of said chute; and/or wherein said reversible sheet feeding rollers comprise at least two separately transversely spaced and separately servo driven rollers, and wherein said sensor system is a plural sensor array extending transversely across said folded sheets output path to provide skewed fold correction control signals for differently controlling said selected stopping position of said separately transversely spaced reversible sheet feeding rollers; and/or wherein for center folding of a sheet said sensor system centrally measures the length of said folded sheet in said folded sheets output path, and provides a fold correction signal if said folded sheet length is greater than one-half the unfolded length of said sheet; and/or wherein for controlled center folding of said sheet said sensor system measures the length of the first said folded sheet in said folded sheets output path, and provides a fold correction signal if said first folded sheet length is greater than one-half the unfolded length of said sheet, to change said selected stopping position of said reversible sheet feeding roller in a first direction to change the fold position of the next folded sheet in said first direction, and said sensor system then measures the folded length of said next folded sheet, and if it is greater than said folded length of said first folded sheet said stopping position of said reversible sheet feeding roller is changed in the opposite direction from said first direction; and/or in a sheet folding system for folding flimsy sheets, such as printed sheets being outputted by a reproduction apparatus, wherein an incoming sheet to be folded is fed into a sheet path by an input sheet feeder and is then buckled from said sheet path into an adjacent sheet folding nip for folding the sheet at a variable selected fold position along the sheet, and a folded sheet output path for said folded sheets from said folding nip, comprising: a folded sheet length sensor system in said folded sheet output path providing a folded sheet length feedback control signal; a continuously variable sheet stopping position sheet stopping system positioned downstream of said sheet feeding nip positioned to engage and stop said incoming sheet in said sheet path in a selected stopping position for a selected fold position for said sheet; said variable sheet stopping position system in said sheet path being electronically connected to said folded sheet length sensor system in said folded sheet output path; said variable sheet stopping position system being programmable for said variable selected fold position along said sheet to provide a selected sheet stopping position, and said selected sheet stopping position of said variable sheet stopping position system being modified by said folded sheet length feedback control signal from said folded sheet length sensor in said folded sheet output path in response to errors in said selected fold position of said sheet; and/or wherein said sensor system is a transverse array of plural sensors additionally providing a sheet folding skew error correction signal for said variable sheet stopping position system, and wherein said variable sheet stopping position system includes a sheet skew correction system; and/or wherein for controlled center folding of an incoming sheet said sensor system measures the length of the first said folded sheet in said folded sheet output path, and provides said folded sheet length feedback control signal if said first folded sheet length is greater than one-half the length of said first incoming sheet; and/or wherein said feedback control signal changes said selected sheet stopping position of the next incoming sheet to be folded in a first direction, and said sensor system then measures the folded length of said next folded sheet, and if it is greater than said folded length of said first folded sheet, said selected sheet stopping position is changed in the opposite direction from said first direction; and/or a method of automatically correcting the desired fold position of flimsy sheets being folded in an automatic sheet folder and outputted in a folded sheet output path, such as for folding printed sheets from a reproduction system, said automatic sheet folder having a folding control system, comprising: providing a sheet folding position selection control signal to said folding control system of said automatic sheet folder to control said desired fold position of a sheet to be folded; detecting the length of the sheet that has been folded in said automatic sheet folder with a folded sheet sensor system in said folded sheet output path; providing folded sheet length output signals from said folded sheet sensor system to said folding control system of said automatic sheet folder corresponding to said length of said folded sheet in said output path; automatically modifying said sheet folding position of said automatic sheet folder for a subsequent sheet to be folded with said folded sheet length output signals in coordination with said sheet folding selection position control signal, to provide automatic correction of said desired fold position; and/or wherein said sheet folding selection position control signal is applied to variable stopping position sheet feeding rollers in said automatic sheet folder; and/or wherein said folded sheet length output signals from said folded sheet sensor system provide a fold skew detection signal applied to said variable stopping position sheet feeding rollers in said automatic sheet folder, and wherein there are two differently driven said variable stopping position sheet feeding rollers which are differently driven in accordance with said fold skew detection signal to correct said fold skew; and/or wherein for even one-half sheet folding said automatically modifying said sheet folding position of said automatic sheet folder for a subsequent sheet to be folded with said folded sheet length output signals in coordination with said sheet folding selection position control signal provides automatic correction of said desired fold position to a minimum measured folded sheet length.

In reproduction apparatus such as xerographic and other copiers and printers or multifunction machines, it is increasingly important to provide faster yet more reliable and more automatic handling of the physical image bearing sheets. It is also desirable in many cases to offer to provide automatic on-line sheet finishing of printed sheets, such as for booklet-making, making book squires of plural 4-up sheets for center binding, flush or Z-folding large insert sheets for smaller size booklets or document sets, and various other well know reasons. It is desirable to reliably feed and accurately register copy sheets of a variety and/or mixture of sizes, types, weights, materials, humidity and other conditions. In particular, it is desirable to minimize sheet misfeeding, skewing, jamming, or damage. Sheets can vary considerably even if they are all of the same "standard" size, (e.g. letter size, legal size, A-4, B-4, etc.). They may have come from different paper batches or have variably changed size with different age or humidity conditions, different imaging, fusing, etc. Sheet skewing, misregistration or misfeeding can also adversely affect further feeding, ejection, and/or stacking and finishing.

The disclosed system may be operated and controlled by appropriate operation of conventional control systems. It is well-known and preferable to program and execute printing, paper handling, and other control functions and logic with software instructions for conventional or general-purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs.

It is well known that the control of document and copy sheet handling systems may be accomplished by conventionally actuating them with signals from a microprocessor controller directly or indirectly in response to simple programmed commands, and/or from selected actuation or non-actuation of conventional switch inputs, such as selecting a copy sheet supply tray, etc. The resultant controller signals may conventionally actuate various conventional electrical servo or solenoid motors, clutches, or other components, the in programmed steps or sequences. Conventional sheet path sensors or switches connected to the controller may be utilized for sensing, counting, and timing the positions of sheets in the sheet paths of the reproduction apparatus, and thereby also controlling the operation of sheet feeders, etc., as is well known in the art.

In the description herein the term "sheet" refers to a usually flimsy physical sheet of paper, plastic, card stock, or other suitable physical substrate for images, whether precut or initially web fed and then cut. A "copy sheet" may be abbreviated as a "copy", or called a "hardcopy". The terms "servo", "servo motor", etc., will be understood to encompass equivalent steppers, stepper motors, etc. The term "fold chute" or the like as used herein will be understood to broadly encompass any of various sheet path portions or segments defined by any of various baffles, plates, rollers or the like used to form or define paper paths.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the examples below, and the claims. Thus, the present invention will be better understood from this description of specific embodiments, including the drawing figures (approximately to scale) wherein:

FIG. 1, labeled "Prior Art", shows a typical traditional buckle folder sheet folding system with different mechanical fold stops (sheet lead edge stops) in a limited number of positions, provided here by plural solenoid actuated gates spaced along the fold baffle plate or chute which, when inserted, cause the upstream portion of the sheet to be buckled up into the fold rolls;

Figure 3:
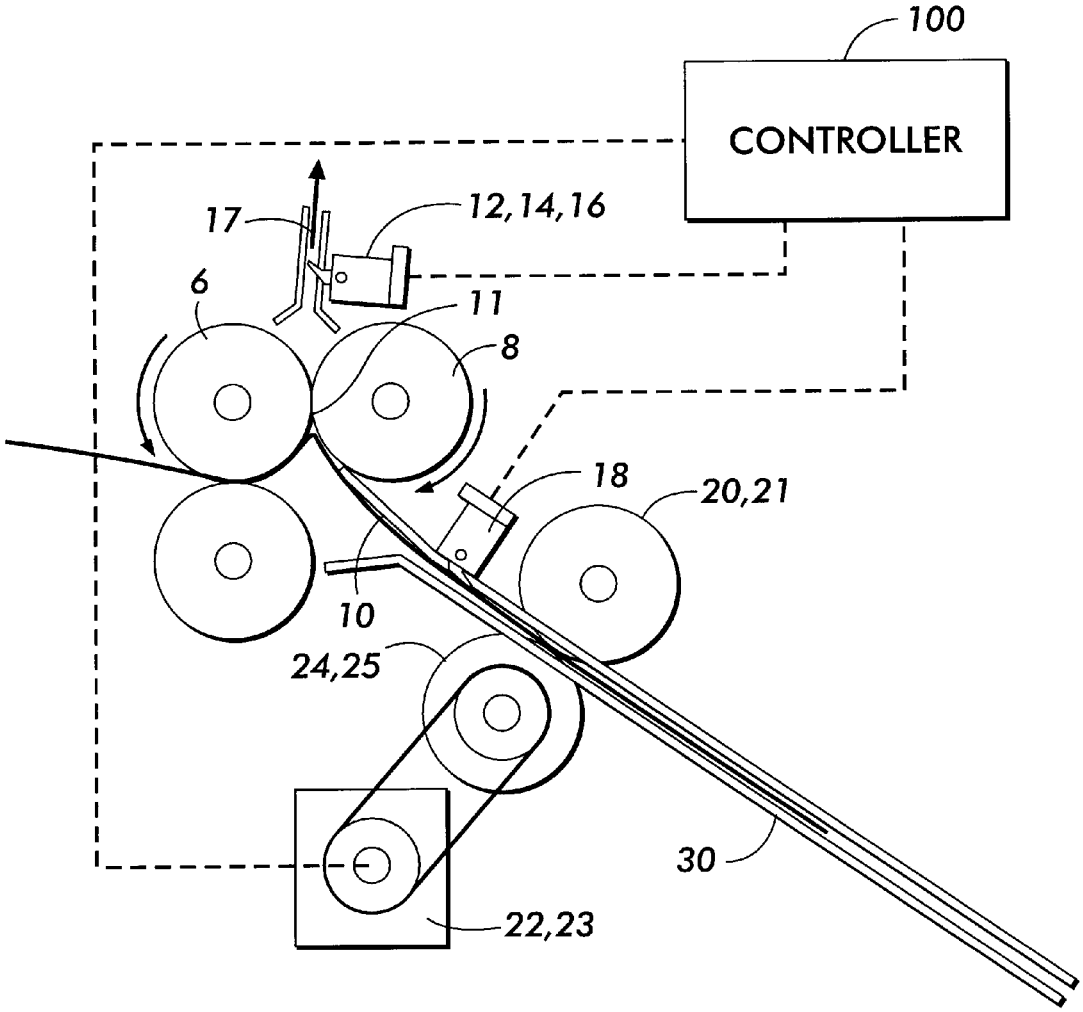
FIG. 3 is the same view as FIG. 2, showing the subsequent operation with the downstream portion of the sheet stopped at the desired position by the stopping of the downstream rollers and sheet buckling towards the fold nip thereby initiated as the sheet continues to be fed in by the upstream feed rollers.
Figure 4:
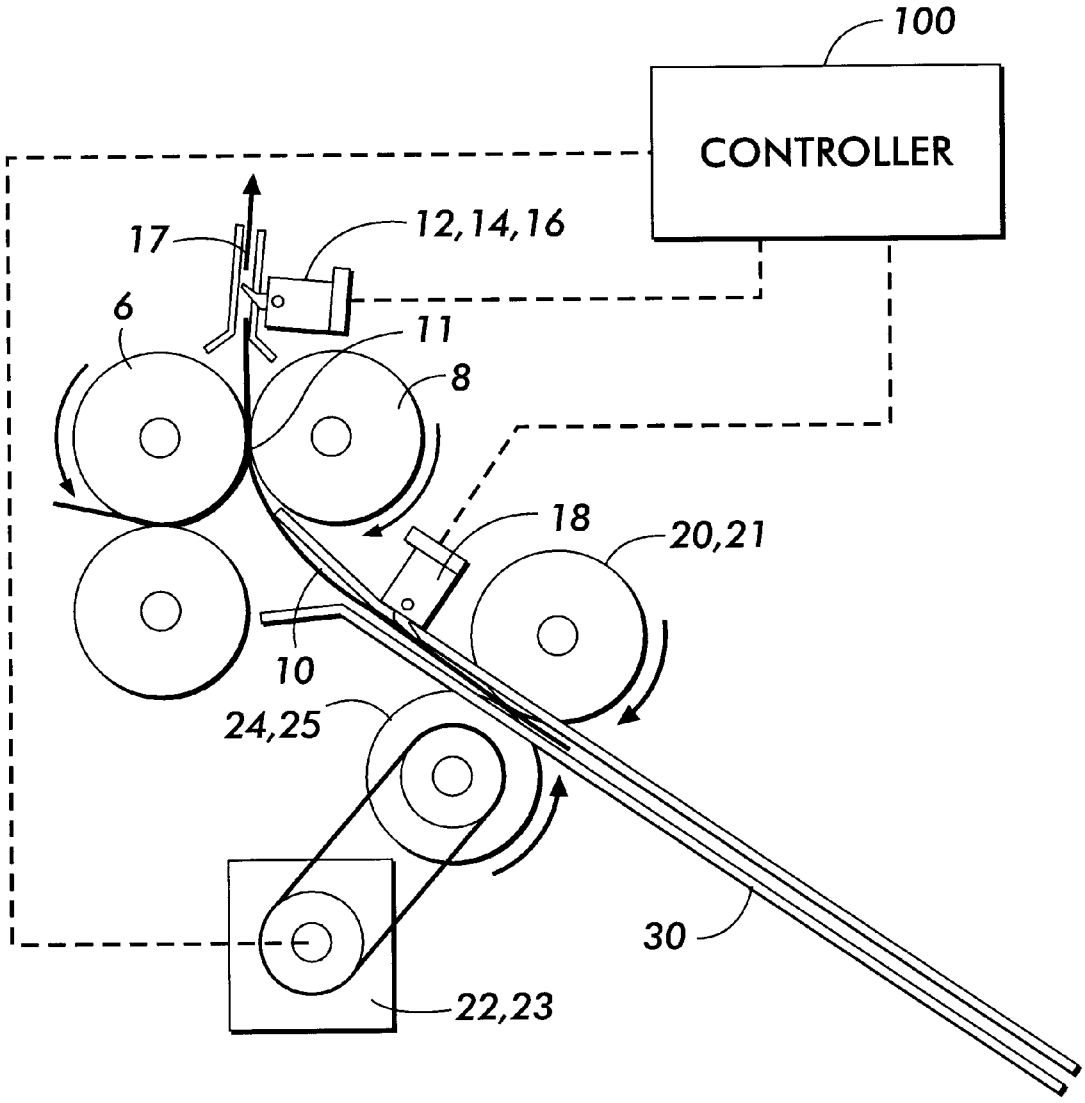
FIG. 4 is the same view as FIGS. 2 and 3, showing the subsequent operation with the downstream portion of the sheet reversed and being fed back into the fold nip for sheet folding by the reversal of the downstream feed rollers.
Figure 5:
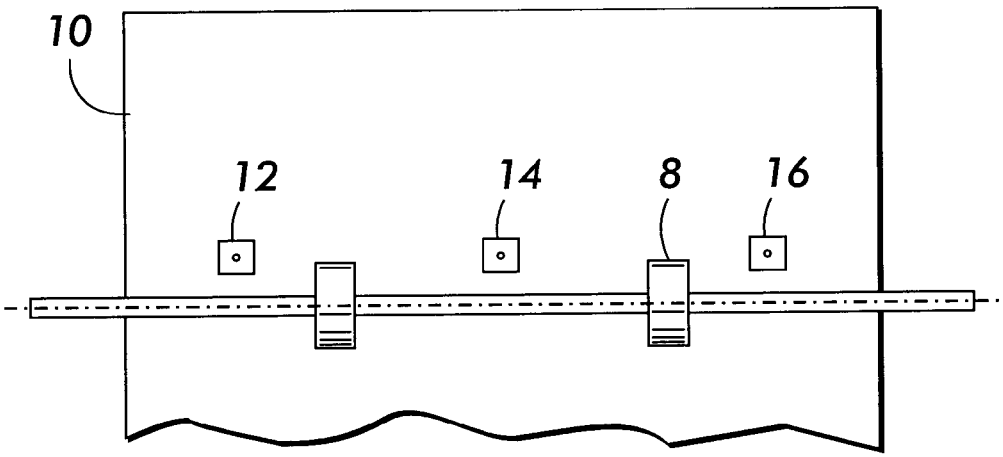
FIG. 5 is a schematic partial top view of the folded sheets output path from the fold nip in the embodiment of FIGS. 2–4 illustrating three plural transversely spaced folded sheet edge sensors.
Figure 6:
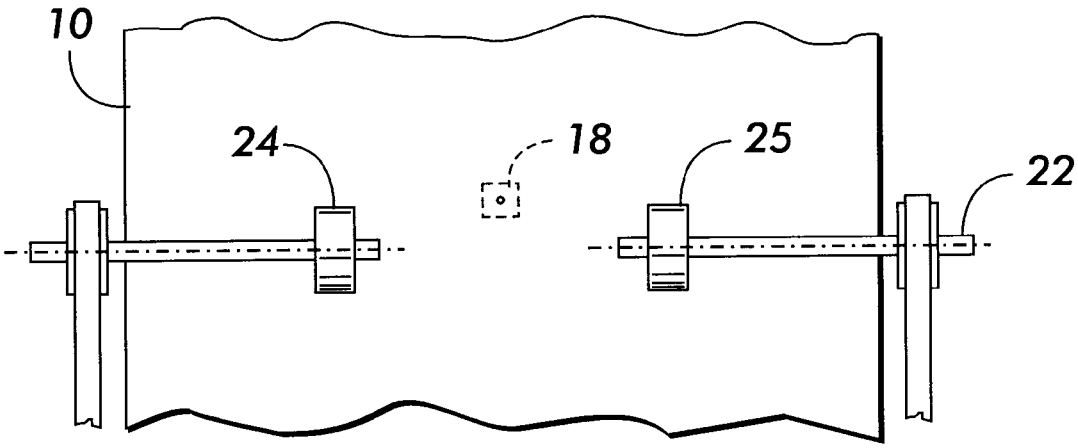
FIG. 6 is a schematic partial bottom view of the downstream portion of the embodiment of FIGS. 2–5, showing the independently servo driven transversely spaced feed rolls and the sheet edge sensor in that sheet path.
Figure 7:
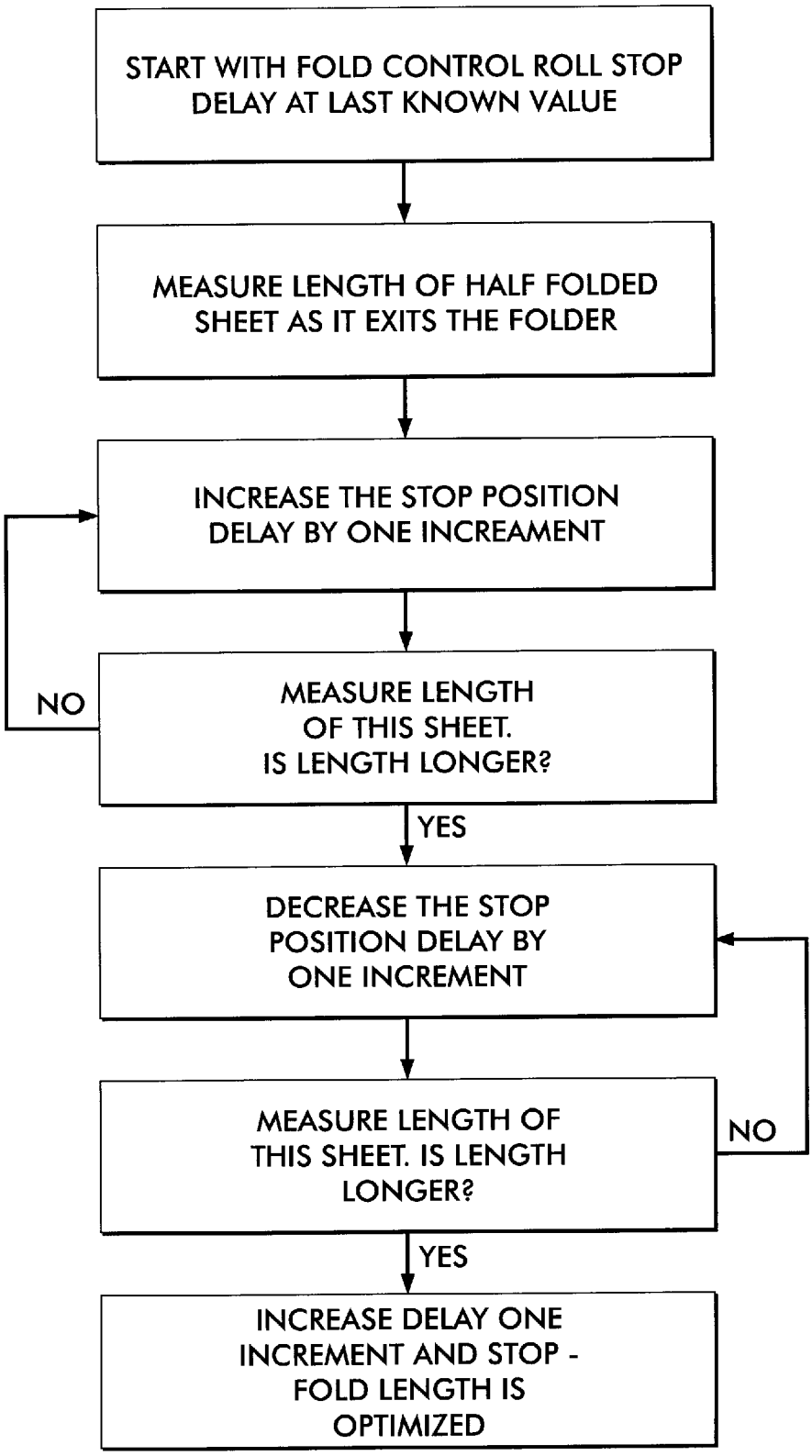
FIG. 7 is a flow chart illustrating one example of the operation of the embodiment of FIGS. 2–5 to provide a correct fold position feedback control system for providing even center (half sheet) folding.
Figure 8:
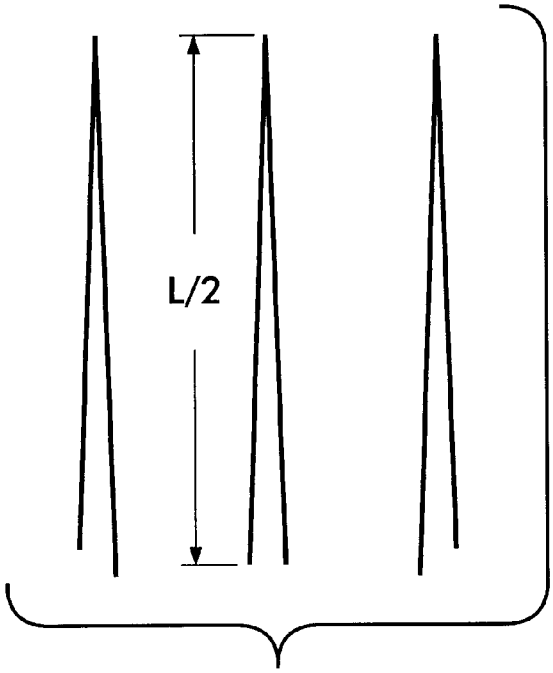
Figure 9:
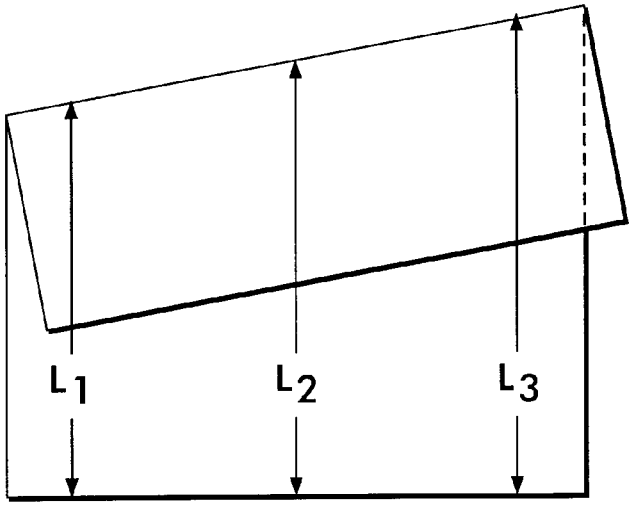

FIG. 8 illustrates the problem addressed by FIG. 7, by showing three different intended center folds of the same size sheet, with the folded sheet shown in the center being correctly evenly center folded (L/2), while the folded sheets on either side thereof show how two different uneven length sheet foldings, with different sides (half sheets) of the fold being slightly longer than the other, but by the same amount, can provide the same sensor signal, by having the same overall folded length as seen by the sensors of FIG. 5; and FIG. 9 illustrates one example of a skewed fold sheet in the operation of the embodiment of FIGS. 2–6, with the amount of skew shown exaggerated for illustrative clarity, showing the 3 sensed skew measurement dimensions for the sensors of FIG. 5.

Describing now in further detail the exemplary embodiments with reference to the Figures, the disclosed sheet folding systems may accurately fold sheets of various sizes, in various desired folding positions. It will be appreciated that these folding systems may be incorporated into, or modularly connected to, the output of various reproduction machines, and can provide rapid automatic on-line folding of the various printed sheets for various purposes. That is, the capabilities of a traditional sheet buckle folder are enhanced here by allowing the folding position to be selected almost anywhere desired along the sheet, not just even-folding (half-folding), and being able to do so for various sheet sizes, even rapid sequences of different intermixed sheet sizes. Various known additions may be made to the sheet paths. For example, providing a selectable folder bypass path and/or providing the folded sheet path here with inversion, or not, of the folded sheets output, as by adding a natural inversion path, or not, to that sheet path.

It will be appreciated by those skilled in the art that although single sheet folding is illustrated here, that well known or conventional sheet set compilers (stackers) could be provided upstream of the subject folder systems to accumulate the desired or suitable number of superposed sheets and to feed those plural superposed sheets into the system for common folding in essentially the same manner as is illustrated for single sheets.

Figure 1:
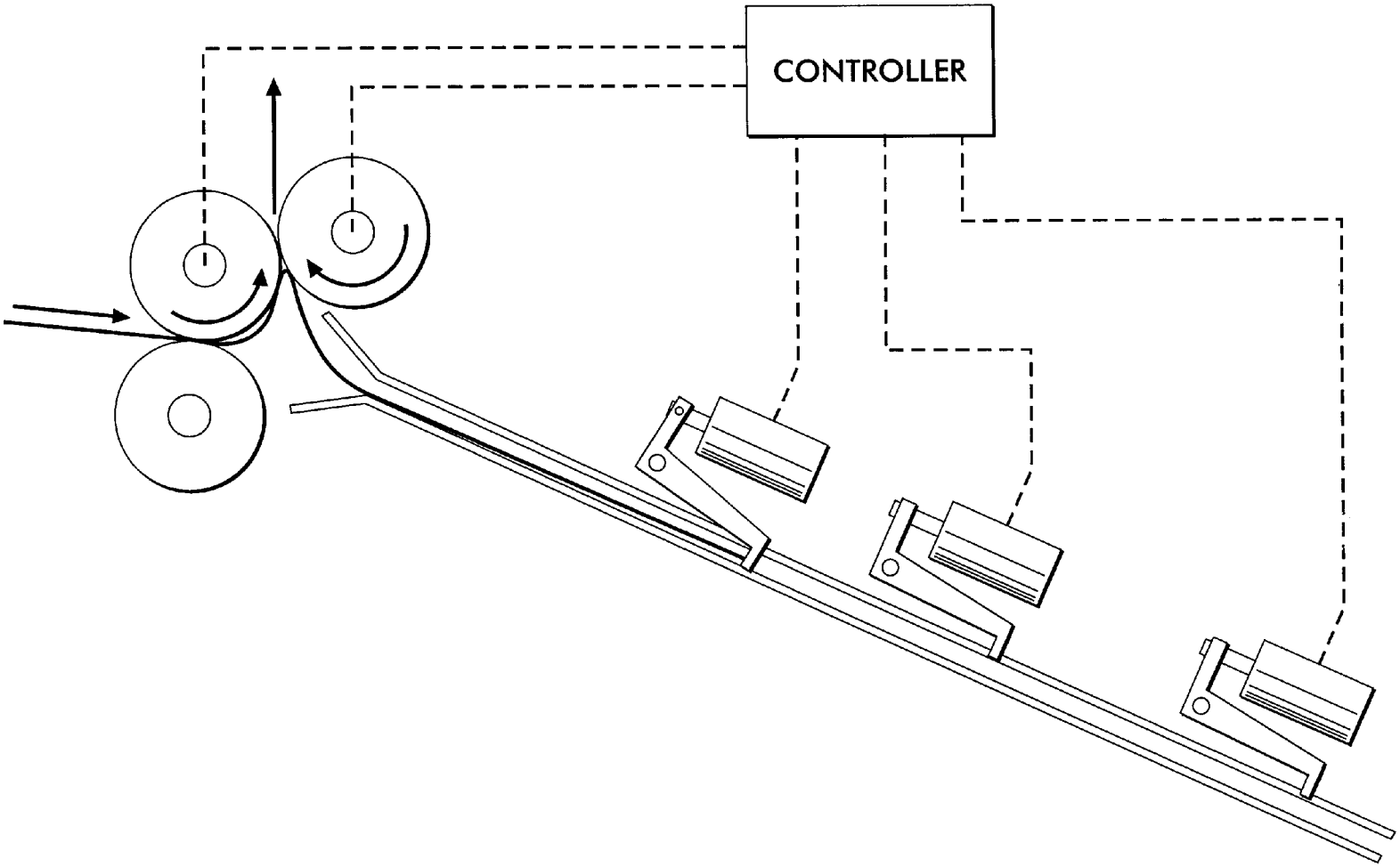
FIG. 1 PRIOR ART

FIG. 1, labeled "prior art", illustrates a prior sheet folding system, limited to three fixed sheet stopping positions by controller selectable solenoid action of one of three registration or sheet lead edge stops inserted into the fold plate or chute so that further in-feeding of the stopped sheet causes it to buckle towards the fold roll nip, which then pulls the sheet into and through that fold nip as shown by the movement arrow.

Turning now to the embodiment of FIGS. 2–6 and its additional fold position correction and skew folding correction features further illustrated in FIGS. 7–9, a number of advantageous features are provided. The capabilities of a traditional sheet buckle folder are enhanced here by automatically providing and adjusting the fold position almost anywhere along the sheet with a feedback system to correct the fold position and/or correct for any fold skewing.

Figure 2:
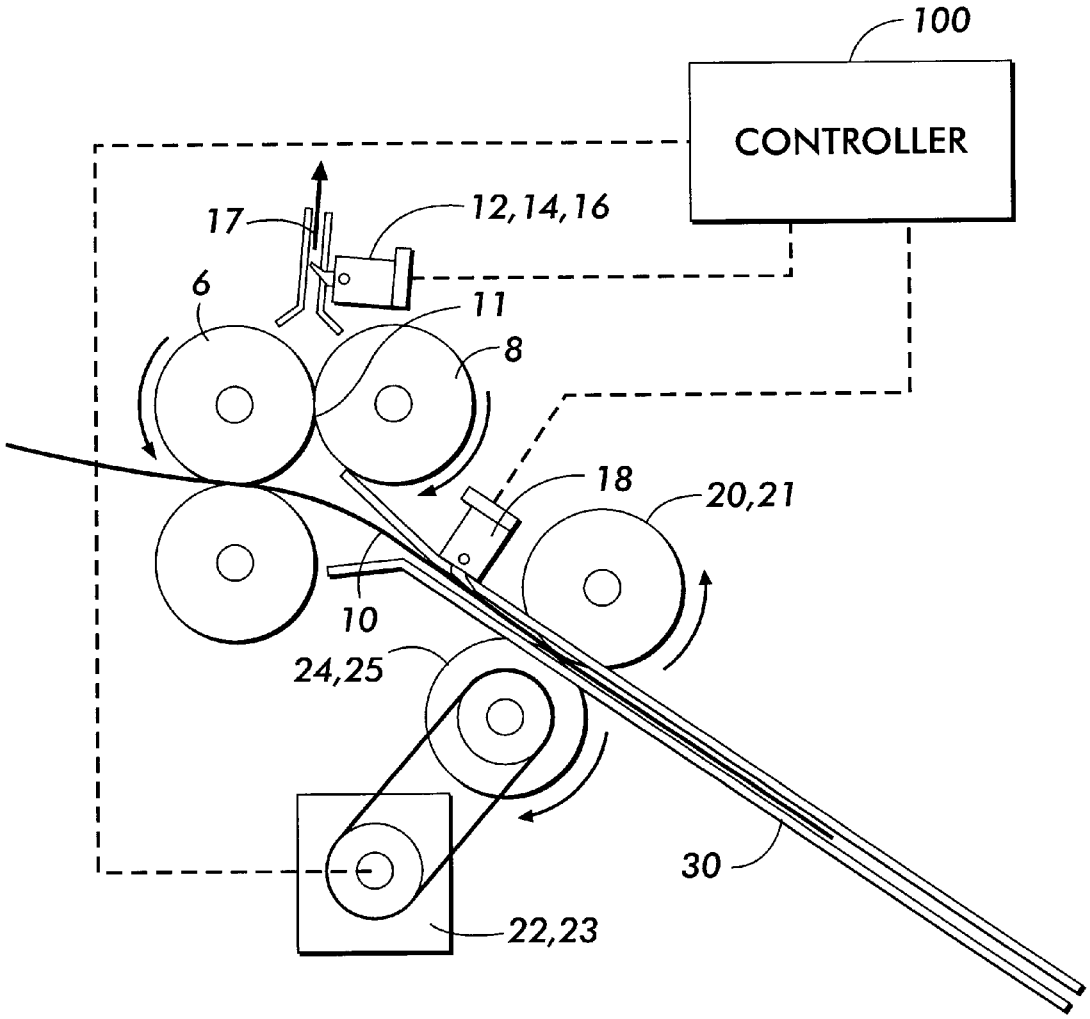
FIG. 2 is a schematic frontal view of one embodiment of the subject sheet folding system, shown as the sheet to be folded is being fed in to the downstream rollers feeding downstream.

FIGS. 2–4 shows in the same view three successive (but uninterrupted) stages or steps of folding a single sheet of paper 10 in this embodiment. The sheet 10 is fed in by an upstream or input feed roll or rollers 6 and its mating idler roll(s) forming a nip therewith. The roll 6 may be driven continuously in the same, downstream feeding, direction. It feeds the sheet into baffles forming the fold plate or chute 30. The chute 30 is at a small angle to the sheet entrance feeding nip, to form a small bend in the sheet therebetween, where buckling is intended to occur. However, buckling does not occur at that point in time. The sheet 10 feeds on into the chute 30 where it is promptly acquired in the nip of downstream feed rollers 24, 25 and their mating idlers 20, 21, located near the entrance to the chute 30. At that point (shown in FIG. 2) the rollers 24 and 25 are still being driven in a direction of rotation to drive or feed the sheet 10 further downstream. The sheet 10 is so fed for a desired distance, then the rollers 24 and 25 are stopped.

That desired distance by which the sheet is fed into the chute 30 by the rollers 24, 25 is based on the operator selected sheet folding position or positions and the operator sheet size, which may be programmed into the controller 100, by an associated separate GUI and/or control signals from the associated reproduction apparatus, and/or a network system server, PDL an/or job tickets in the case of a digital printer. The rollers 24 and 25 here are preferably respectively independently, but coordinatingly, driven by reversible servomotor drives 22, 23. The sensor 18, just upstream of the rollers 24 and 25, has detected the entering sheet's lead edge and signaled that information to the controller 100, so that the sheet is coordinated to the folder system itself. The rollers 24 and 25 are now automatically stopped in response to the controller indicating that the sheet 10 is in the desired position to start folding.

The continued feeding in of the sheet by the roller 6 after the rollers 24, 25 are stopped causes the sheet to buckle towards the sheet-folding nip 11 formed here by rollers 6 and 8, as in the FIG. 3 example. In that time period, i.e., after starting the sheet buckling but before the fold nip 11 acquires the sheet 10, the servomotors 22, 23 may desirably reverse the direction of rollers 24, 25 to positively feed the downstream portion of the sheet 10 which they are engaging back upstream towards the fold nip 11. Thus, both sides of the sheet fold may be positively driven into the fold nip. Further, the sheet 10 does not have to be pulled out of the nip of the rollers 24, 25 by the folding rolls 6 and 8 as they continue to fold the sheet. Rather, the sheet being folded is being positively fed back upstream by those reversed rollers 24, 25, as shown in the example of FIG. 4. The folded sheet passes out through an output path 17, past sensors 12, 14, 16.

If there is any error in that folding process, that error can be sensed and corrected—automatically self-adjusted for the next sheet folded. A sheet folding position correction system example here for center-folded sheets is particularly illustrated in FIGS. 7 and 8. However, as noted, the present system is not limited just to center folding.

For any sheet fold position, the fold position correction system may utilize information from at least one of the sensors 12, 14, 16 in the folded sheet output path 17 after the nip of the fold rolls 6 and 8, preferably the center sensor 14. Since the constant velocity of the fold rolls 6 and 8 is known, by measuring the time it takes the folded sheet in path 17 to pass the sensor 14 (the folded sheet lead edge detection time to the trail edge detection time), the length of the folded sheet is thereby known, and may be stored in controller 100. This folded sheet length information can be used to control the stopping time of the fold controlling rollers 24, 25, and thus control and correct the sheet position for folding, for any desired fold position, as will be explained.

For desired off-center folding (anything other than center folding), such as placing the fold line one-third of the way along a sheet, it has been found here that fold error correction can be accomplished simply by comparing the above-measured length or passage time of the folded sheet against the inputted or measured length or passage time of that sheet before it was folded (or the selected sheet size in the printer from which it was originally fed). From that simple software comparison, it can be easily determined if the actual fold position is in error as compared with the desired fold position, and the amount and direction of error correction needed determined. Thereby a corresponding change in the rollers 24, 25 stopping position to correct that error for the next sheet of that size to be folded can be immediately generated.

However, if center folding (even folding) of the sheet has been selected, there is an additional problem in, maintaining and/or correcting the proper fold position, as illustrated in FIG. 8, which may be dealt with by the system illustrated in the flow chart of FIG. 7. FIG. 7 is a flow chart illustrating one example of the operation of the embodiment of FIGS. 2–5 to provide a correct center fold position feedback control system, for providing even center (half sheet) folding. FIG. 8 illustrates the problem addressed by FIG. 7 by showing three different attempted center folds of the same size sheet. The center folded sheet shown in the middle is correctly evenly folded (to a folded length of L/2, where L is the unfolded sheet length in the process or sheet movement direction). The folded sheets shown on opposite sides of the central sheet in FIG. 7 show two slightly unevenly folded sheets, both having the same overall folded length, i.e., both longer than L/2 by the same amount, and thus giving the same signal from the sensor 14, even though their folding errors are different (opposite), with different sides of the fold being longer than the other.

The sensor 14 signal can tell that those two unevenly folded sheets in FIG. 8 are not correctly center folded because their folded length is not exactly one-half of the original sheet length, and thus tell the amount of correction (the amount greater than L/2) needed, but cannot tell in which direction that correction must be made, i.e., whether to increase or decrease the sheet stopping position of the rollers 24, 25. An algorithm for determining that, to making the correct correction, is shown in the flow chart of FIG. 8. This may be done while running the folder, and the correction may be accomplished in one, or two, sheet folding operations. The derived correction amount from measuring the length of the first sheet folded (or, a fixed small increment), is either added to (as shown) or subtracted from, the previous stop position of the rollers 24, 25. The length of the next sheet folded, having that fold position correction, is then measured. If the correction was in the right direction, that second folded sheet will be measured shorter, up to its minimum (L/2) evenly folded length. If the error correction was in the wrong direction, the folded sheet length will now be measured longer (increased fold position error=increased folded sheet length). In the latter case, the system then knows that the direction of correction must be reversed for the next (third) folded sheet. Thus, all subsequent sheets after the first or second will be correctly center folded. If this correction process is done in fixed small increments or steps instead of by the total measured error, it may be repeated, until the fold length is optimized at L/2.

Note that if only sheet folding position correction is to be provided, without also providing fold skew correction, that the rollers 24, 25 can be a single or common axis roller and commonly driven, and only one folded sheet length sensor 14 is needed.

Turning now to FIGS. 5, 6 and 9, in particular, there is illustrated the disclosed example of an optional additional correction system for sheet folding skew. It may be operated simultaneously with all of the other above described operations and functions of this embodiment. It utilizes all three of the sensors 12, 14, 16 positioned transversely across the path of the folded sheet in path 17. Thus, as illustrated in FIG. 9, a sheet folded with a skewed fold will provide three different sheet length signals for three different folded sheet lengths $L_1$, $L_2$, $L_3$ in the three different positions measured by the sensors 12, 14, 16—in the center and on two opposite side positions. (Alternatively, the three different lead edge timing signals could be used, since the lead edge of a skew folded sheet is skewed relative to the sensor 12, 14, 16 array.) After the nominal length of the fold has been optimized in the center ($L_2$), as previously described above, the outer two dimensions $L_1$ and $L_3$ can be compared to the center dimension $L_2$ to see if the fold is square ($L_1=L_2=L_3$) or is skewed, with unequal measured lengths, and hence needs skew correction.

Skew correction here is provided by the independent servo drives 22 and 23 of the independently rotatable rollers 24 and 25. Their respective stopping positions (or sheet drive velocities) may be varied relative to one another by the amount of skew correction needed. This will skew the downstream portion of the sheet in those nips relative to the upstream portion of the same sheet in the nip of input roll 6, and thus skew (to remove prior skew from) the fold line. This correction process to provide square (non-skewed) sheet folding may otherwise be similar to correction process described above for fold position errors, including the special case method for the correction of half-folded sheets, where the direction of skew would also be ambiguous as sensed.

The above skew correction system could alternatively be used in a system for deliberately folding sheets with a desired, controlled, slight amount of skew. For example to provide folded sheets that would have part of their edges providing identifying tabs, separators or banner sheets, by slightly sticking out of the edges of a stack of square or square folded sheets of the same size.

It will be appreciated that the above or other configurations of this sheet folding system may be incorporated into an existing reproduction and/or finishing system, to provide optional sheet folding to be provided inside of existing reproduction machines or output modules therefor, in existing spaces. The subject sheet inverting system may also be part of a plural output paths system for a choice of processing of the printed sheets from a reproduction apparatus. Thus, the addition of a large extra attached module to provide folding, such as a third party sheet folder module, requiring additional floor space, can be avoided.

While the embodiments disclosed herein is are preferred, it will be appreciated from this teaching that various alternatives, modifications, variations or improvements therein may be made by those skilled in the art, which are intended to be encompassed by the following claims.

What is claimed is:

1. An improved sheet folder for folding flimsy printed sheets, with an automatic feedback controlled fold position correction system, comprising input sheet feed rollers, a fold chute with a chute entrance, reversible sheet feeding rollers in said fold chute, fold rollers, a folded sheets output path, and a sensor system for the folded sheets in said folded sheets output path, wherein a sheet to be folded is partially fed into said fold chute by said input sheet feed rollers and a downstream portion of said sheet is engaged in said chute by said reversible sheet feeding rollers and fed further into said chute by said reversible sheet feeding rollers by a selected distance corresponding to a desired fold position for said sheet, and then said reversible sheet feeding rollers are stopped at a selected stopping position relative to said sheet and reversed to feed said desired fold position of said sheet into said fold rollers for folding said sheet with both said reversible sheet feeding rollers and said input sheet feed rollers, and wherein said fold rollers then feeds said folded sheet into said folded sheets output path, wherein said sensor in said folded sheets output path senses the length of folded sheets in said folded sheets output path to provide a control signal for controlling said selected stopping position of said reversible sheet feeding rollers to provide said fold position correction system, wherein said reversible sheet feeding rollers comprise at least two separately transversely spaced and separately servo driven rollers, and wherein said sensor system is a plural sensor array extending transversely across said folded sheets output path to provide skewed fold correction control signals for differently controlling said selected stopping position of said separately transversely spaced reversible sheet feeding rollers.

2. The improved sheet folder with an automatic feedback controlled fold position correction system of claim 1, wherein said reversible sheet feeding rollers are mounted adjacent to said chute entrance of said chute.

3. An improved sheet folder for folding flimsy printed sheets, with an automatic feedback controlled fold position correction system, comprising input sheet feed rollers, a fold chute with a chute entrance, reversible sheet feeding rollers in said fold chute, fold rollers, a folded sheets output path, and a sensor system for the folded sheets in said folded sheets output path, wherein a sheet to be folded is partially fed into said fold chute by said input sheet feed rollers and a downstream portion of said sheet is engaged in said chute by said reversible sheet feeding rollers and fed further into said chute by said reversible sheet feeding rollers by a selected distance corresponding to a desired fold position for said sheet, and then said reversible sheet feeding rollers are stopped at a selected stopping position relative to said sheet and reversed to feed said desired fold position of said sheet into said fold rollers for folding said sheet with both said reversible sheet feeding rollers and said input sheet feed rollers, and wherein said fold rollers then feeds said folded sheet into said folded sheets output path, wherein said sensor in said folded sheets output path senses the length of folded sheets in said folded sheets output path to provide a control signal for controlling said selected stopping position of said reversible sheet feeding rollers to provide said fold position correction system, wherein for center folding of a sheet said sensor system centrally measures the length of said folded sheet in said folded sheets output path, and provides a fold correction signal if said folded sheet length is greater than one-half the unfolded length of said sheet.

4. An improved sheet folder for folding flimsy printed sheets, with an automatic feedback controlled fold position correction system, comprising input sheet feed rollers, a fold chute with a chute entrance, reversible sheet feeding rollers in said fold chute, fold rollers, a folded sheets output path, and a sensor system for the folded sheets in said folded sheets output path, wherein a sheet to be folded is partially fed into said fold chute by said input sheet feed rollers and a downstream portion of said sheet is engaged in said chute by said reversible sheet feeding rollers and fed further into said chute by said reversible sheet feeding rollers by a selected distance corresponding to a desired fold position for said sheet, and then said reversible sheet feeding rollers are stopped at a selected stopping position relative to said sheet and reversed to feed said desired fold position of said sheet into said fold rollers for folding said sheet with both said reversible sheet feeding rollers and said input sheet feed rollers, and wherein said fold rollers then feeds said folded sheet into said folded sheets output path, wherein said sensor in said folded sheets output path senses the length of folded sheets in said folded sheets output path to provide a control signal for controlling said selected stopping position of said reversible sheet feeding rollers to provide said fold position correction system, wherein for controlled center folding of said sheet said sensor system measures the length of the first said folded sheet in said folded sheets output path, and provides a fold correction signal if said first folded sheet length is greater than one-half the unfolded length of said sheet, to change said selected stopping position of said reversible sheet feeding roller in a first direction to change the fold position of the next folded sheet in said first direction, and said sensor system then measures the folded length of said next folded sheet, and if it is greater than said folded length of said first folded sheet said stopping position of said reversible sheet feeding roller is changed in the opposite direction from said first direction.

5. In a sheet folding system for folding flimsy sheets, such as printed sheets being outputted by a reproduction apparatus, wherein an incoming sheet to be folded is fed into a sheet path by an input sheet feeder and is then buckled from said sheet path into an adjacent sheet folding nip for folding the sheet at a variable selected fold position along the sheet, and a folded sheet output path for said folded sheets from said folding nip, comprising:

a folded sheet length sensor system in said folded sheet output path providing a folded sheet length feedback control signal;

a continuously variable sheet stopping position sheet stopping system positioned downstream of said sheet feeding nip positioned to engage and stop said incoming sheet in said sheet path in a selected stopping position for a selected fold position for said sheet;

said variable sheet stopping position system in said sheet path being electronically connected to said folded sheet length sensor system in said folded sheet output path;

said variable sheet stopping position system being programmable for said variable selected fold position along said sheet to provide a selected sheet stopping position, and said selected sheet stopping position of said variable sheet stopping position system being modified by said folded sheet length feedback control signal from said folded sheet length sensor in said folded sheet output path in response to errors in said selected fold position of said sheet;

wherein for controlled center folding of an incoming sheet said sensor system measures the length of the first said folded sheet in said folded sheet output path, and provides said folded sheet length feedback control signal if said first folded sheet length is greater than one-half the length of said first incoming sheet.

6. In a sheet folding system for folding flimsy sheets, such as printed sheets being outputted by a reproduction apparatus, wherein an incoming sheet to be folded is fed into a sheet path by an input sheet feeder and is then buckled from said sheet path into an adjacent sheet folding nip for folding the sheet at a variable selected fold position along the sheet, and a folded sheet output path for said folded sheets from said folding nip, comprising:

a folded sheet length sensor system in said folded sheet output path providing a folded sheet length feedback control signal;

a continuously variable sheet stopping position sheet stopping system positioned downstream of said sheet feeding nip positioned to engage and stop said incoming sheet in said sheet path in a selected stopping position for a selected fold position for said sheet;

said variable sheet stopping position system in said sheet path being electronically connected to said folded sheet length sensor system in said folded sheet output path;

said variable sheet stopping position system being programmable for said variable selected fold position along said sheet to provide a selected sheet stopping position, and said selected sheet stopping position of said variable sheet stopping position system being modified by said folded sheet length feedback control signal from said folded sheet length sensor in said folded sheet output path in response to errors in said selected fold position of said sheet, wherein said sensor system is a transverse array of plural sensors additionally providing a sheet folding skew error correction signal for said variable sheet stopping position system, and wherein said variable sheet stopping position system includes a sheet skew correction system, wherein said feedback control signal changes said selected sheet stopping position of the next incoming sheet to be folded in a first direction, and said sensor system then measures the folded length of said next folded sheet, and if it is greater than said folded length of said first folded sheet, said selected sheet stopping position is changed in the opposite direction from said first direction.

7. A method of automatically correcting the desired fold position of flimsy sheets being folded in an automatic sheet folder and outputted in a folded sheet output path, such as for folding printed sheets from a reproduction system, said automatic sheet folder having a folding control system, comprising:

providing a sheet folding position selection control signal to said folding control system of said automatic sheet folder to control said desired fold position of a sheet to be folded;

detecting the length of the sheet that has been folded in said automatic sheet folder with a folded sheet sensor system in said folded sheet output path;

providing folded sheet length output signals from said folded sheet sensor system to said folding control system of said automatic sheet folder corresponding to said length of said folded sheet in said output path;

automatically modifying said sheet folding position of said automatic sheet folder for a subsequent sheet to be folded with said folded sheet length output signals in coordination with said sheet folding selection position control signal, to provide automatic correction of said desired fold position, wherein said sheet folding selection position control signal is applied to variable stopping position sheet feeding rollers in said automatic sheet folder, wherein said folded sheet length output signals from said folded sheet sensor system provide a fold skew detection signal applied to said variable stopping position sheet feeding rollers in said automatic sheet folder, and wherein there are two differently driven said variable stopping position sheet feeding rollers which are differently driven in accordance with said fold skew detection signal to correct said fold skew.

8. The method of automatically correcting the desired fold position of flimsy sheets being folded in an automatic sheet folder of claim 7, wherein for even one-half sheet folding said automatically modifying said sheet folding position of said automatic sheet folder for a subsequent sheet to be folded with said folded sheet length output signals in coordination with said sheet folding selection position control signal provides automatic correction of said desired fold position to a minimum measured folded sheet length.

* * * * *